US007159542B2

(12) United States Patent
Bryant

(10) Patent No.: US 7,159,542 B2
(45) Date of Patent: Jan. 9, 2007

(54) INTERNAL COMBUSTION ENGINES

(75) Inventor: Michael John Bryant, West Midlands (GB)

(73) Assignee: Preservation Holdings Limited, Jersey (GB)

( * ) Notice: Subject to any disclaimer, the term of this patent is extended or adjusted under 35 U.S.C. 154(b) by 142 days.

(21) Appl. No.: 10/525,333

(22) PCT Filed: Aug. 20, 2003

(86) PCT No.: PCT/GB03/03643

§ 371 (c)(1),
(2), (4) Date: Feb. 22, 2005

(87) PCT Pub. No.: WO2004/018854

PCT Pub. Date: Mar. 4, 2004

(65) Prior Publication Data

US 2006/0150929 A1 Jul. 13, 2006

(30) Foreign Application Priority Data

Aug. 23, 2002 (GB) ..... 0219708.5

(51) Int. Cl.
*F02B 75/04* (2006.01)

(52) U.S. Cl. ..... 123/48 B; 123/78 E

(58) Field of Classification Search ..... 123/48 R, 123/48 B, 78 R, 78 E, 78 F
See application file for complete search history.

(56) References Cited

U.S. PATENT DOCUMENTS 6,009,845 A 1/2000 Ehrlich

FOREIGN PATENT DOCUMENTS

| | | |
|---|---|---|
| EP | 0 248 655 | 12/1987 |
| EP | 0 898 644 | 3/1999 |
| EP | 1 012 459 | 6/2000 |

*Primary Examiner*—Noah P. Kamen
(74) *Attorney, Agent, or Firm*—Reed Smith LLP; Harry K. Ahn

(57) ABSTRACT

An internal combustion engine includes one or more pistons (4), each of which is mounted to reciprocate in a respective cylinder (2) and is pivotably connected to a connecting rod (6) which is connected to a respective crank on a crankshaft (7). The connecting rod (6) is pivotably connected to one end of an elongate link (14), which is pivotably connected to the associated crank at a point intermediate its ends and whose other end constitutes a rod (18) which is restrained by a mounting (20, 24) such that it may pivot about a pivotal axis parallel to the axis of the crankshaft. The mounting includes a first movable mounting member (20) and a second movable mounting member (24). The first mounting member (20) is connected to the rod (18) by a connection which permits only relative sliding movement in the direction of the length of the rod and is pivotally connected to the second mounting member (24) to pivot with respect thereto about the said pivotal axis. A single actuator (30) is provided which cooperates with the second mounting member (24) and is arranged to move it. The second mounting member (24) is an elongate lever which is connected to a fixed structure to pivot with respect thereto about an axis substantially parallel to the axis of crankshaft.

9 Claims, 4 Drawing Sheets

INTERNAL COMBUSTION ENGINES

CROSS-REFERENCES TO RELATED APPLICATIONS

This application claims priority to International Application No. PCT/GB2003/003643 filed Aug. 20, 2003, which claims priority to British application No. 0219708.5 filed Aug. 23, 2002, the entire disclosure of which is hereby incorporated by reference.

BACKGROUND OF THE INVENTION

The present invention relates to internal combustion engines of the type in which the compression ratio and the swept volume may be altered during operation of the engine. More specifically, the invention relates to internal combustion engines including one or more pistons, each of which is mounted to reciprocate in a respective cylinder and is pivotally connected to a connecting rod which is connected to a respective crank on a crankshaft, the connecting rod being pivotally connected to one end of an elongate link member which is pivotably connected to the associated crank at a point intermediate its ends and whose other end constitutes a rod which is restrained by a mounting such that it may pivot about a pivotal axis parallel to the axis of the crankshaft, the mounting including a first movable mounting member and a second movable mounting member, the first movable mounting member being connected to the rod by a connection which permits only relative sliding movement in the direction of the length of the rod and the first movable mounting member being connected to the second movable mounting member to be pivotable with respect thereto about the said pivotal axis, a single actuating means being provided which cooperates with the second movable mounting member and is arranged to move it.

Such an engine is disclosed in EP-B-0898644. In the engine disclosed in this patent, the first mounting member comprises a sleeve or the like which slidably retains the rod of the link member and is pivotally connected to the second mounting member which is selectively movable by an actuator in a direction parallel to the axis of the associated cylinder. Movement of the first mounting member in this direction results primarily in a change in the top dead centre position of the piston and thus in the compression ratio, though also in a small change in the bottom dead centre position of the piston and thus in the stroke of the piston.

It is, however, often desirable to be able to make a substantial change to the stroke of the piston and thus to the swept volume of the engine and to this end EP-B-1012459 discloses a modified engine which includes two actuators. The first actuator is arranged to move the first mounting member parallel to the cylinder axis, and thus changes the compression ratio of the engine, and is carried by the second actuator, which is arranged to move the first actuator and thus the first mounting member perpendicular to the cylinder axis and thus changes the stroke of the piston and thus the swept volume of the engine. The engine of EP-B-1012459 thus enables the compression ratio and the swept volume of the engine to be changed at will independently of one another.

However, the inclusion of a second actuator in the engine of EP-B-1012459 adds not inconsiderably to its structural complexity and cost and also to the complexity of the control system that is required. Although the engine may be operated with any desired combination of values of compression ratio and swept volume within the ranges that may be obtained, it is now appreciated that this is in fact not necessary in all cases. Thus at relatively low speed and/or load a relatively small swept volume and a relatively high compression ratio are desirable whilst at relatively high speed and/or load a relatively large swept volume and a relatively low compression are desirable. Although the actuators are able to position the mounting so that a large swept volume is provided in combination with a high compression ratio and also a small swept volume in combination with a low compression ratio, these operating configurations may in practice rarely be required.

It is in practice necessary, in connection with the engines disclosed in the prior patents referred to above, to provide an extension to the crankcase which constitutes a housing for the actuator system beside the engine roughly at the level of the crankshaft. In practice, some vehicle engine compartments and space constraints may render the provision of such a structure difficult.

SUMMARY OF THE INVENTION

It is, therefore, the object of the invention to provide an engine of the type referred to above which has the advantage of being able to adjust both the compression ratio and the swept volume but with reduced complexity and hence cost.

According to the present invention, the second movable mounting member is an elongate lever which is connected to a fixed structure to pivot with respect thereto about an axis substantially parallel to the axis of the crankshaft.

Thus in the engine in accordance with the invention, the mounting for the elongate bar comprises a sleeve or the like which slidably retains the bar within it and is pivotally connected to an elongate lever, which is also pivotally connected to a fixed structure. The actuator cooperates with the elongate lever and can move it only in rotation about its pivotal axis. This necessarily means that the first mounting member is moved not linearly but over an arcuate path. Movement along this arcuate path may be resolved into movement perpendicular to the axis of the cylinder and movement parallel to the axis of the cylinder and thus operation of a single actuator will result in both the compression ratio and the swept volume of the engine changing. The precise ratio of movement perpendicular and parallel to the cylinder axis between the end points of the arcuate path may be varied in accordance with requirements by altering the length of the elongate lever and the position of its pivotal mounting.

As mentioned above, it has been appreciated that it may not be necessary to provide a full range of combinations of compression ratio and swept volume and the invention is based on the recognition that if one plots the combinations of compression ratio and swept volume which are actually useful in practice on a graph of compression ratio against swept volume, the various points lie for many engines on a generally arcuate line. By appropriately dimensioning the elongate lever and positioning its pivot point, the first mounting member can be caused to move along an arcuate path which corresponds in qualitative terms to the arcuate line referred to on the graph above. This means that by providing a pivotally mounted elongate lever, it is possible for the mounting to be adjusted to obtain substantially all the combinations of compression ratio and swept volume that are in practice normally required using only a single actuator.

The actuator, which is preferably a linear actuator, preferably acts directly on the elongate lever. Thus in the preferred embodiment, the elongate lever is rotatably carried by a shaft mounted in fixed mountings and the actuator acts on the lever to rotate it with respect to the shaft.

However, in an alternative embodiment the elongate lever is non-rotatably mounted on an actuator shaft which is rotatably mounted in fixed mountings, i.e. bearings, and the actuator acts on the shaft to rotate it. In this case, the actuator may be a rotary actuator which acts directly on the actuator shaft but it is preferred that the engine includes an actuator lever which is also non-rotatably connected to the actuator shaft and that the actuator acts on the actuator lever, in which case the actuator may again be of linear type. Thus the actuator shaft may be of non-circular section, e.g. hexagonal, splined or the like, and the elongate lever and the actuator lever, if provided, will then have a hole in one end whose shape corresponds to that of the actuator shaft. Movement of the free end of the actuator lever will then result in rotation of the actuator shaft within its fixed mountings which will in turn result in pivotal movement of the elongate lever and thus movement of the first movable mounting member along an arcuate path.

It is likely that the actuator will be of active or positive type, that is to say of the type which is powered, e.g. electrically or hydraulically and actively causes the elongate lever to move pivotally about its mounting axis. However, this may not be essential and in a further embodiment the actuator is of negative or passive type, that is to say it does not actively cause the elongate lever to move but instead merely permits it to move. In this embodiment, the actuator is therefore more in the form of a selectively releasable lock. Thus tests have shown that the elongate rod exerts substantial fluctuating moments on the mounting and these moments tend to cause pivotal movement of the elongate lever in one direction and then in the other direction alternately. It is therefore possible to make use of these moments or torques by locking the mounting in position and releasing it at the time at which it is desired to move the elongate lever in a specific direction. This may be done by sensing when the torque is tending to cause the elongate lever to move in that direction and then releasing the releasable lock to permit the desired movement to occur, whereafter the releasable lock is reapplied. In practice, it may not be possible for all of the desired movement of the elongate lever to occur in a single continuous movement because the torque applied to it fluctuates and reverses very rapidly and it may therefore be necessary for the releasable lock to be released on each of a number of successive occasions when the torque acting on it is acting in the correct direction and reapplying the lock at times between those occasions, whereby the elongate lever will move incrementally until it has reached the desired position.

It is, however, preferred that the actuator is constructed to operate in the manner of a ratchet and is selectively switchable to prevent movement of the second movable mounting member or to permit movement in a selected one of two directions whilst preventing movement in the opposite direction. The advantage of this construction is of course that it is not necessary to detect when the forces acting on the second movable mounting member are acting in a particular direction and the selectively operable lock is merely effectively unlocked in one selected direction but maintained locked in the other direction. This will mean that the selective lock will permit movement of the second movable mounting member in the desired direction each time the forces acting on it act in that direction but will prevent movement in the opposite direction. A sensor will determine when the desired amount of movement has occurred and the selectively operable lock will then be fully locked again until some further movement is required.

In one specific embodiment, the actuator includes a hydraulic cylinder accommodating a piston connected to the second movable mounting member, the piston dividing the cylinder into two chambers filled with hydraulic fluid, the two chambers communicating via two conduits, each of which includes a non-return valve and a control valve which is selectively operable to permit the piston to be moved by the forces acting on it in a predetermined direction.

Actuation of the positive actuator or release of the selectively releasable lock will of course be controlled by a central control system, e.g. incorporated in the engine management system, which is now conventionally provided on automotive engines, in response to signals produced by a number of sensors indicative of, amongst other things, engine load, engine speed, position of the crankshaft and the like.

BRIEF DESCRIPTION OF THE DRAWINGS

Further features and details of the invention will be apparent from the following description of three specific embodiments which is given by way of example only with reference to the accompanying diagrammatic drawings, in which.

DETAILED DESCRIPTION OF THE DRAWINGS

Figure 1:
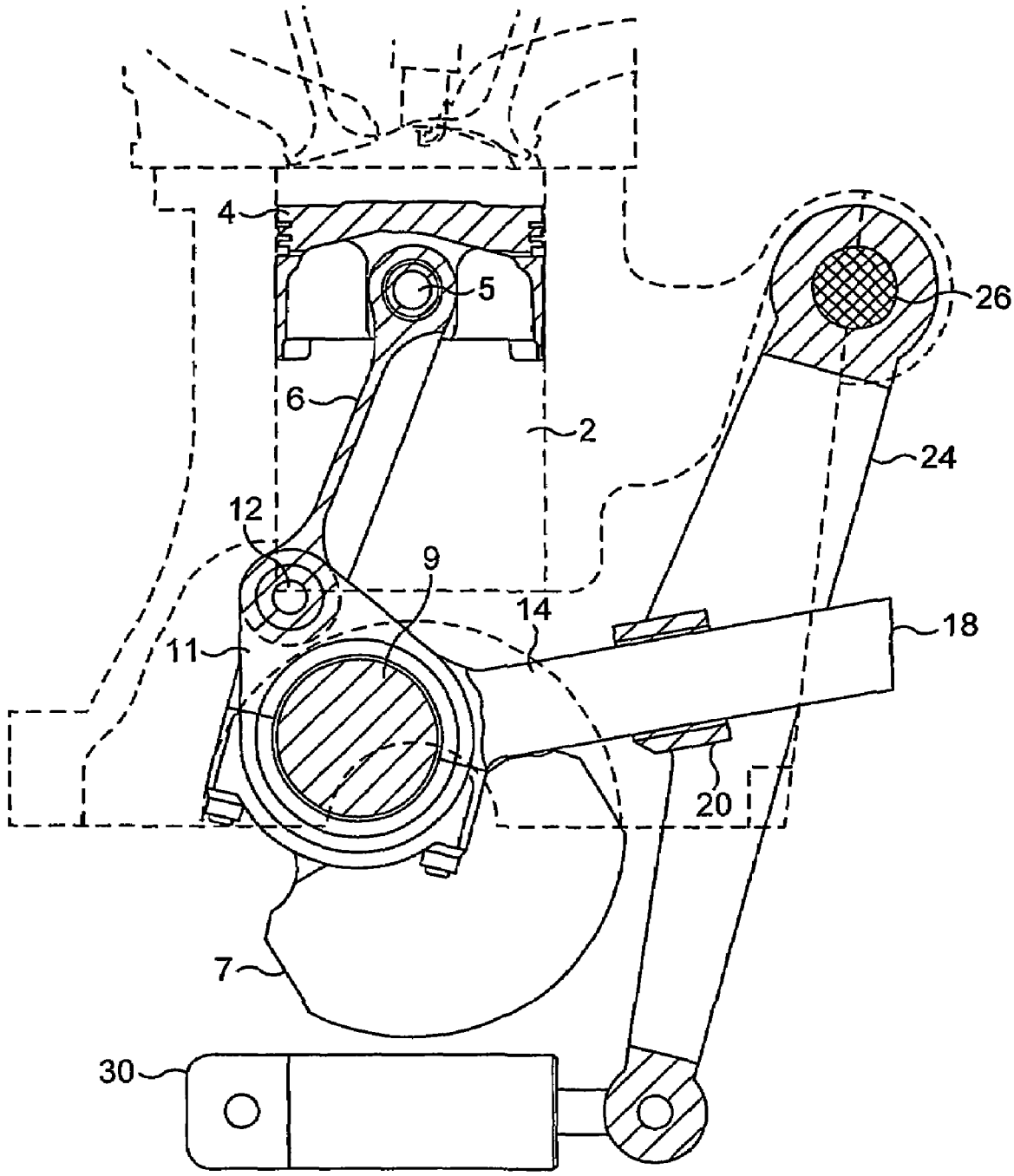
FIG. 1 is a schematic view of the first embodiment showing only a part of a multi-cylinder four-stroke engine in accordance with the invention with the mounting shown in the position in which the engine has a low compression ratio and a high capacity or swept volume.

In the embodiment of FIG. 1, the engine has four cylinders, though it may have more or less than this or even only a single cylinder, but only a single cylinder 2 is shown. All those features of the engine which are wholly conventional and form no part of the present invention, such as the cylinder block, the cylinder head, the inlet and outlet valves and the spark plug are shown only in chain lines and will not be described in detail. Reciprocably mounted in the cylinder is a piston 4. The piston is pivotally connected about an axis 5 in the usual manner to a connecting rod 6. Extending below each cylinder 2 is a crankshaft 7, which carries a respective crank or crank throw 9 for each piston. The connecting rod 6 is not directly connected to the associated crank but instead pivotally connected about an axis 12 to one end 11 of a respective elongate link 14. which has two portions inclined to one another by about 120°. The link is also pivotally connected at a point intermediate its ends to the associated crank 9. The other end 18 of the link 14, which is in the form of a bar, is longitudinally slidably received in a mounting. The bar 18 may be of circular section, in which event it may be hollow, or it may be cut away for weight-saving purposes, in which case it may be generally of I cross-section or cruciform cross-section, with webs defining an outer surface of substantially circular shape to facilitate longitudinal sliding and lateral force transfer.

The mounting includes a first movable mounting member 20, which is constituted by a sleeve defining a hole or passage through which the bar 18 passes and is slidably retained therein. The sleeve 20 is accommodated in the space between and pivotally connected to the two limbs 22 of a respective bifurcated mounting lever 24 at a point intermediate its ends. The sleeve 20 may thus pivot or rotate with respect to the lever 24 about an axis which is parallel to the axis of the crankshaft. One end of the lever 24 has a hole of circular shape in which a complementarily shaped stationary shaft 26, attached to the cylinder block, is rotatably received. The other end of the lever 24 is connected to a positive actuator, in this case a linear hydraulic actuator 30. Extension or retraction of the actuator 30 will result in rotation of the lever 24 about the shaft 26. The sleeve 20 is thus caused to move over an arcuate path.

Figure 2:
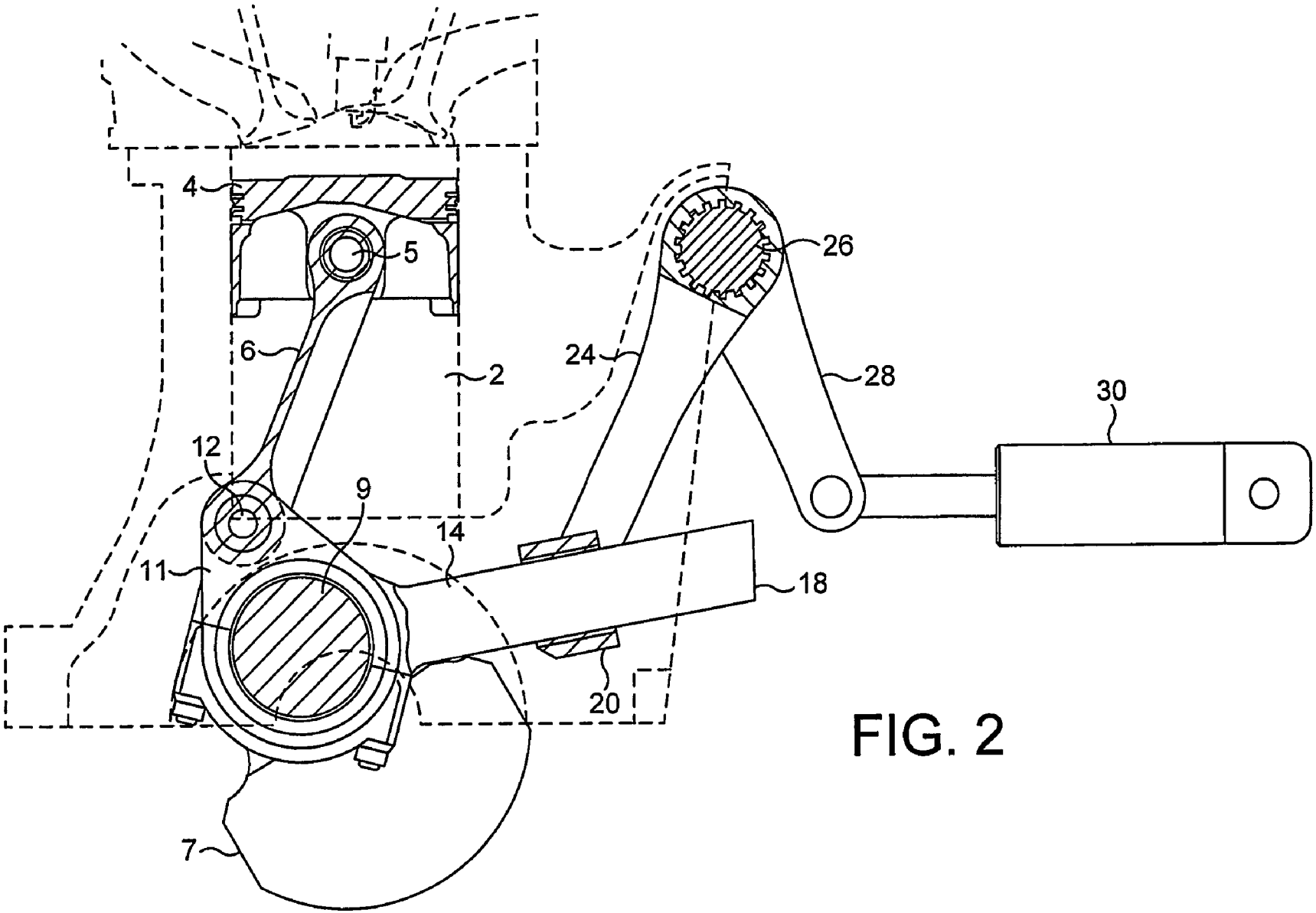
FIG. 2 is a similar view of the second embodiment.

In use, the engine operates in substantially the same manner as that disclosed in EP-B-1012459, to which reference should be made. During steady state operation of the engine, the bar 18 reciprocates linearly within the sleeve 20 and the sleeve 20 reciprocates in rotation about its pivotal connection with the lever 24. If the engine is operating at high speed and/or under high load, the mounting is held in the position shown in FIG. 1 in which the compression ratio is relatively low and the swept volume of the engine is high. If, however, the speed and/or load should drop, this is sensed by various sensors and the engine management system then issues a signal to the actuator to move the mounting into the position shown in FIG. 3 in which the compression ratio is relatively high and the capacity of the engine relatively low. The engine management system can be programmed to move the mounting progressively between its two end positions or alternatively it may be programmed to switch the mounting between the two end positions or to switch it incrementally between any predetermined number of set positions. The second embodiment illustrated in FIG. 2 is very similar to that illustrated in FIG. 1 and differs from it in that the actuator 30 does not act directly on the lever 24. In this case, the shaft 26 is not stationary but constitutes an actuator shaft and one end of the lever 24 has a hole of non-circular shape in which the complimentarily shaped actuator shaft 26 is non-rotatably received. The actuator shaft is retained at its two ends by stationary bearings, e.g. mounted on the side of the cylinder block, and thus cannot move linearly but is mounted to rotate about its own axis in the bearings. Also connected to the actuator shaft 26 is an actuator lever 28, which is again non-rotatable with respect to the shaft 26. Connected to the free end of the actuator lever 28 is a positive actuator, in this case a linear hydraulic actuator 30, which can actively move the lever 28 and thus turn the shaft 26. Extension or retraction of the actuator will result in rotation of the shaft 26 about its axis and thus in rotation also of the lever 24 about the axis of the shaft 26. The sleeve 20 is thus again caused to move over an arcuate path.

Figure 3:
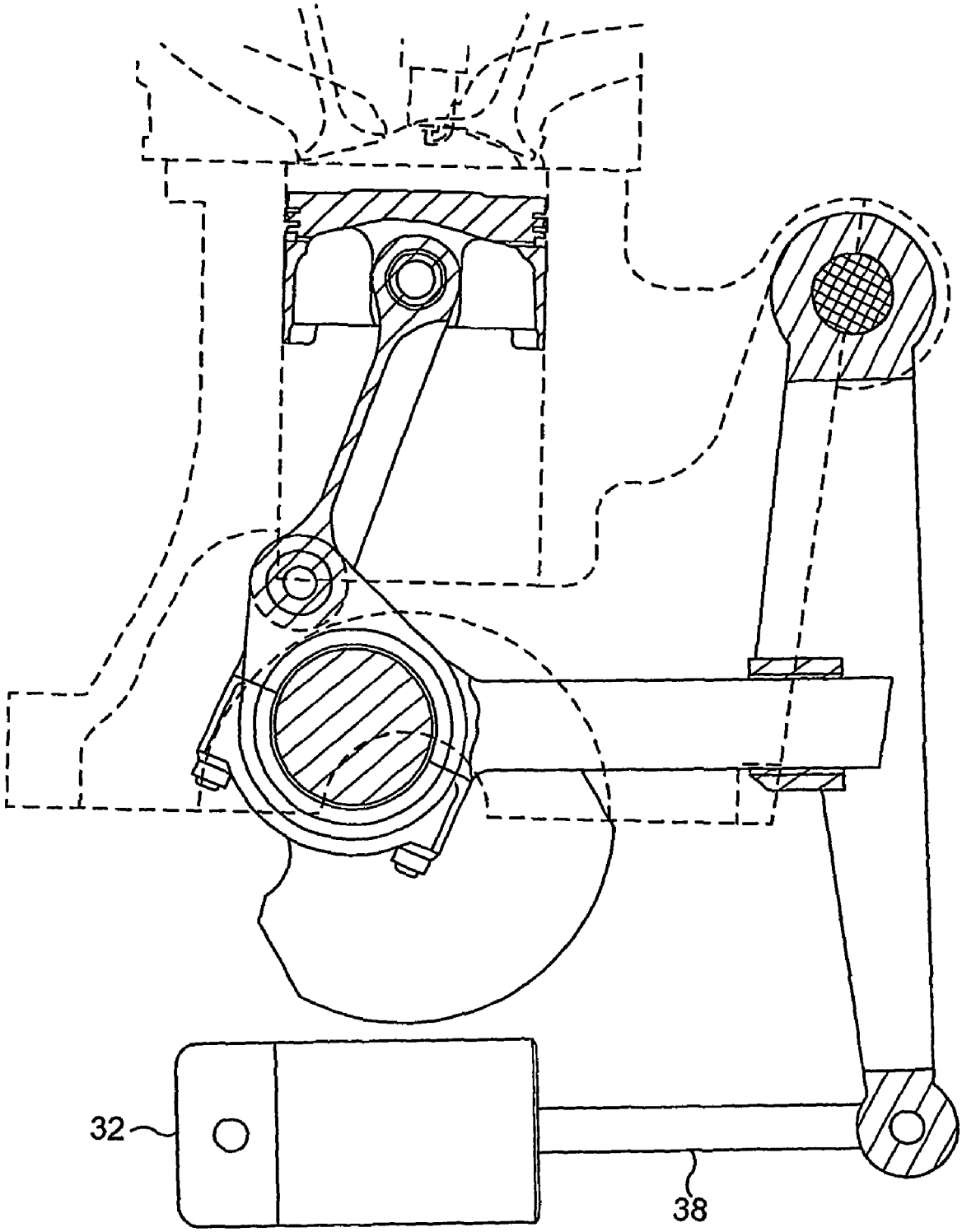
FIG. 3 is a similar view of the second embodiment but with the mounting in the position in which the engine has a high compression ratio and a low capacity or swept volume.

FIG. 3 also illustrates the third embodiment which is essentially the same as the first embodiment except that the active actuator 30 is replaced by a passive actuator 32 or selectively operable brake which can not actively move the lever 24 but can be selectively released to permit the lever 24 to be moved, that is to say rotated by the fluctuating torques which act on it. In this case, the actuator 32 is constructed to operate in the manner of a ratchet, that is to say it may be switched to permit movement of the lever 24 under the forces acting on, it in a selected direction but to prevent movement in the opposite direction.

Figure 4:
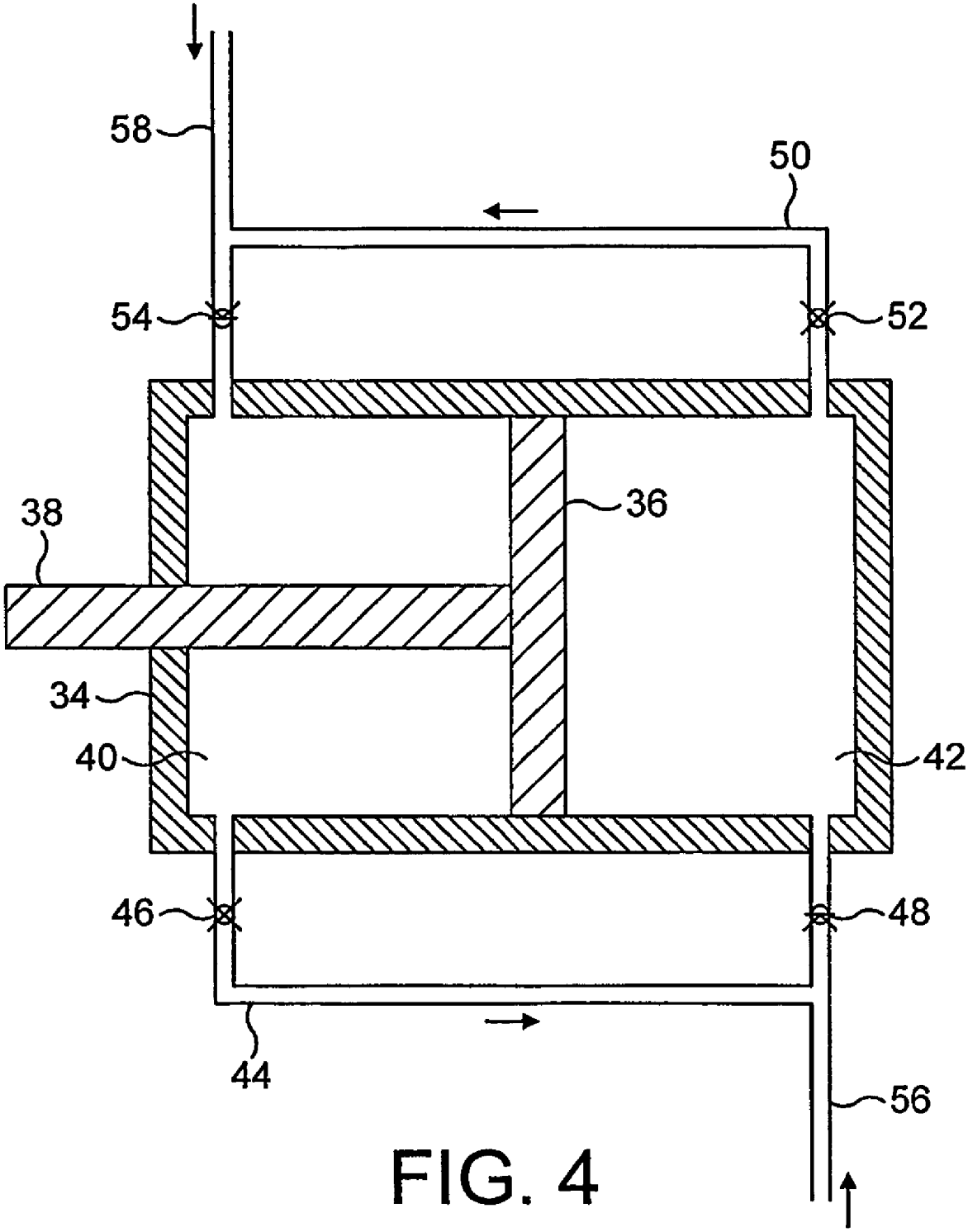
FIG. 4 is a diagrammatic view of the passive actuator or selectively releasable lock used in the embodiment of FIG. 2.

FIG. 4 is a detailed diagrammatic view of the passive actuator 32. It again consists of a hydraulic cylinder 34, in which is a piston 36, the piston rod 38 of which is pivotally connected to the end of the lever 24. The piston divides the cylinder into two spaces 40, 42, which are filled with hydraulic fluid. The two spaces 40, 42 are connected by a first conduit 44, which includes a first control valve 46 and a first one-way valve 48, and by a second conduit 50, which includes a second control valve 52 and a second one-way valve 54. Both conduits 44 and 50 also communicate with an unpressurised source, which is typically unpressurised, of hydraulic fluid via respective conduits 56, 58 so that any leakage is compensated for.

If it is desired to move the piston rod 38 to the left, as seen in FIG. 4, the engine management system opens the control valve 46. Fluid is then displaced, each time there is a force acting on the piston rod tending to move it to the left, from the space 40 via the valves 46 and 48 into the space 42 until the desired amount of movement has occurred and the valve 46 is then closed, whereafter the actuator is hydraulically locked. If it is desired to move the piston rod to the right, the same procedure is adopted but in this case the control valve 52 is opened. It will be appreciated that the purpose of the non-return valves is to prevent the piston being moved by the action of the reverse force acting on it when one or other of the control valves is open.

In the embodiment of FIGS. 3 and 4, the passive actuator 32 acts on the lever 24 in the same manner as the positive actuator 30 in the embodiment of FIG. 1. It would, however, also be possible for the passive actuator to act on an actuating lever 28 in the manner shown in FIG. 2 or to act directly between the lever 24 and the shaft 26 so as to selectively permit or prevent rotation of the lever 24 about the shaft 26. Numerous other modifications could readily be devised.

The invention claimed is:

1. An internal combustion engine including one or more pistons, each of which is mounted to reciprocate in a respective cylinder and is pivotally connected to a connecting rod which is connected to a respective crank on a crankshaft, the connecting rod being pivotally connected to one end of an elongate link member which is pivotably connected to the associated crank at a point intermediate its ends and whose other end constitutes a rod which is restrained by a mounting such that it may pivot about a pivotal axis parallel to the axis of the crankshaft, the mounting including a first movable mounting member and a second movable mounting member, the first movable mounting member being connected to the rod by a connection which permits only relative sliding movement in the direction of the length of the rod and the first movable mounting member being connected to the second movable mounting member to be pivotable with respect thereto about the said pivotal axis, a single actuating means being provided which cooperates with the second movable mounting member and is arranged to move it, characterised in that the second movable mounting member is an elongate lever which is connected to a fixed structure to pivot with respect thereto about an axis substantially parallel to the axis of the crankshaft.

2. An engine as claimed in claim 1 in which the elongate lever is rotatably carried by a shaft mounted in fixed mountings and the actuator acts on the lever to rotate it with respect to the shaft.

3. An engine as claimed in claim 1 in which the elongate lever is a non-rotatably connected to an actuator shaft which is rotatably mounted in fixed mountings, and the actuator acts on the shaft to rotate it.

4. An engine as claimed in claim 3 including an actuator lever which is non-rotatably connected to the actuator shaft and the actuator acts on the actuator lever.

5. An engine as claimed in claim 1 in which the elongate lever is bifurcated and comprises two arms between which the first movable mounting member is received and to which the first movable mounting member is pivotally connected.

6. An engine as claimed in claim 1 in which the actuator is of positive type and is arranged positively to move the second movable mounting member.

7. An engine as claimed in claim 1 which the actuator is of passive type and constitutes a selectively releasable lock which may be released to permit the second movable mounting member to be moved under the action of the forces exerted on it by the rod.

8. An engine as claimed in claim 7 in which the actuator is constructed to operate in the manner of a ratchet and is selectively switchable to prevent movement of the second movable mounting member or to permit movement in a selected one of two directions whilst preventing movement in the opposite direction.

9. An engine as claimed in claim 8 in which the actuator includes a hydraulic cylinder accommodating a piston connected to the second movable mounting member, the piston dividing the cylinder into two chambers filled with hydraulic fluid, the two chambers communicating via two conduits, each of which includes a non-return valve and a control valve which is selectively operable to permit the piston to be moved by the forces acting on it in a predetermined direction.

* * * * *